US005821858A

United States Patent [19]

Stone

[11] Patent Number: 5,821,858

[45] Date of Patent: Oct. 13, 1998

[54] LIGHTED SLIPPER

[75] Inventor: Allan J. Stone, Weston, Fla.

[73] Assignee: Cobra International, Inc., Sunrise, Fla.

[21] Appl. No.: 864,147

[22] Filed: May 28, 1997

[51] Int. Cl.[6] ..... G08B 23/00

[52] U.S. Cl. ..... 340/573; 340/693; 36/137; 362/103

[58] Field of Search ..... 340/573, 665, 340/691, 693; 36/137; 362/103, 802, 800

[56] References Cited

U.S. PATENT DOCUMENTS

| | | | |
|---|---|---|---|
| 993,251 | 5/1911 | Howard | 482/1 |
| 3,067,322 | 12/1962 | Sala | 362/103 |
| 3,070,907 | 1/1963 | Rocco | 36/8.3 |
| 4,158,922 | 6/1979 | Dana, III | 36/137 |
| 4,231,079 | 10/1980 | Heminover | 362/106 |
| 4,308,572 | 12/1981 | Davidson et al. | 362/103 |
| 4,367,515 | 1/1983 | Beard | 362/103 |
| 4,463,412 | 7/1984 | Broach | 362/61 |
| 4,748,366 | 5/1988 | Taylor | 310/328 |
| 4,848,009 | 7/1989 | Rodger | 36/137 |
| 5,033,212 | 7/1991 | Evanyk | 36/137 |
| 5,052,131 | 10/1991 | Rondini | 36/137 |
| 5,237,760 | 8/1993 | Altman et al. | 36/137 |
| 5,303,131 | 4/1994 | Wu | 362/103 |
| 5,357,697 | 10/1994 | Lin | 36/137 |
| 5,371,662 | 12/1994 | Shen-ko | 362/276 |
| 5,381,615 | 1/1995 | MacMillan | 36/137 |
| 5,396,720 | 3/1995 | Hwang et al. | 36/137 |
| 5,406,724 | 4/1995 | Lin | 36/137 |
| 5,419,061 | 5/1995 | Barrocas | 36/137 |
| 5,457,900 | 10/1995 | Roy | 36/137 |
| 5,461,188 | 10/1995 | Drago et al. | 84/600 |
| 5,477,435 | 12/1995 | Rapisarda et al. | 362/189 |
| 5,483,759 | 1/1996 | Silverman | 36/137 |
| 5,490,338 | 2/1996 | Hwang et al. | 36/137 |
| 5,500,635 | 3/1996 | Mott | 340/573 |
| 5,529,499 | 6/1996 | Martinez | 434/258 |
| 5,546,681 | 8/1996 | Goldston et al. | 36/137 |

*Primary Examiner*—Jeffery A. Hofsass
*Assistant Examiner*—Sihong Huang
*Attorney, Agent, or Firm*—Oltman, Flynn & Kubler

[57] ABSTRACT

A lighted shoe apparatus includes a shoe having a shoe body, several externally visible light emitting elements mounted to the shoe body for lighting in a sequence, a logic circuit including an Or gate for supplying logic and power to the logic circuit, a clock for generating an output signal, a counter for converting the clock output signal into a number sequence, several And gates each corresponding and connected to one of the light emitting elements for receiving the number sequence and lighting the corresponding light emitting element selectively for certain numbers in the number sequence, a control switch for activating and deactivating the logic circuit, and an interconnection conductor electrically joining the Or gate and the control switch. The light emitting elements preferably each include a light emitting diode. The shoe preferably includes an insole and the control switch is preferably a pressure activated switch mounted in the insole for activation with the applied weight of the shoe wearer onto the insole. The shoe body preferably includes a vamp and the light emitting elements are preferably mounted to the vamp. The shoe is preferably a slipper.

10 Claims, 5 Drawing Sheets

F1

| A | B | F1 |
|---|---|---|
| 0 | 0 | 1 |
| 0 | 1 | 0 |
| 1 | 0 | 0 |
| 1 | 1 | 0 |

F2

| A | B | F2 |
|---|---|---|
| 0 | 0 | 0 |
| 0 | 1 | 1 |
| 1 | 0 | 0 |
| 1 | 1 | 0 |

F3

| A | B | F3 |
|---|---|---|
| 0 | 0 | 0 |
| 0 | 1 | 0 |
| 1 | 0 | 1 |
| 1 | 1 | 0 |

F4

| A | B | F4 |
|---|---|---|
| 0 | 0 | 0 |
| 0 | 1 | 0 |
| 1 | 0 | 0 |
| 1 | 1 | 1 |

F5

| A | B | F5 |
|---|---|---|
| 0 | 0 | 0 |
| 0 | 1 | 0 |
| 1 | 0 | 0 |
| 1 | 1 | 1 |

F6

| A | B | F6 |
|---|---|---|
| 0 | 0 | 0 |
| 0 | 1 | 1 |
| 1 | 0 | 1 |
| 1 | 1 | 1 |

$F_6 = AB - AB - AB$

LIGHTED SLIPPER

BACKGROUND OF THE INVENTION

1. Field of the Invention

The present invention relates generally to the field of footwear. More specifically the present invention relates to a slipper or other type of shoe containing a lighting assembly. The assembly includes an array of outwardly directed light emitting diodes (LED's) mounted to the slipper vamp which light in a repeating sequence when a wearer shifts weight onto the slipper insole, a logic circuit, and a grounded, pressure-activated control switch hidden underneath the slipper insole and interconnection wiring electrically joining the logic circuit and the control switch.

The logic circuit includes an Or gate for supplying logic and power to the logic circuit, a clock for generating an output signal, a counter for converting the output signal into a number sequence, several And gates each corresponding and connected to one of the light emitting elements for receiving the number sequence and lighting the corresponding light emitting element selectively for only a certain number or numbers in the number sequence.

2. Description of the Prior Art

There has long been footwear equipped with lighting assemblies including power circuits and lighting elements such as LED's and incandescent bulbs.

Dana III, U.S. Pat. No. 4,158,922, issued on Jun. 26, 1979, teaches flashing disco shoes. Dana III discloses a shoe containing an electric circuit including a solid state oscillator for periodically activating and deactivating several lighting elements. A control switch is provided which may take the form of a tilt switch. A problem with Dana III is that flashing caused by a simple oscillator is limited to a simultaneous off and on repetition. Various and complex flashing sequences are not provided.

Davidson, et al., U.S. Pat. No. 4,308,572, issued on Dec. 29, 1981, reveals articles having light-emitting elements energizable in sequences to provide desired visual displays. An article of clothing made of fabric material contains a flexible circuit board fitted with light emitting elements which project through the outer fabric surface. The light emitting elements are flashed in sequence by an electronically operable sequencer and a matrixing circuit, which may take the form of separate or combined circuit chips. A problem with Davidson, et al., is that the chips and other circuit elements make it relatively expensive to manufacture. Another problem is that no provision is made for installation in footwear.

Roy, U.S. Pat. No. 5,457,900, issued on Oct. 17, 1995, discloses a footwear display device. Roy includes a control CPU for calculating the velocity of the footwear as it moves through a stepping motion and for causing several lighting elements to flash in sequence at a rate corresponding to the footwear velocity. The lighting elements may together display an intelligible message. A problem with Roy is that incorporation of a CPU adds considerable cost to the unit.

MacMillan, U.S. Pat. No. 5,381,615, issued on Jan. 17, 1995 teaches footwear incorporating a multiple-switch lighting circuit. A shoe includes several lighting elements and a power source connected through forward and rearward pressure switches and through a logic circuit. The logic circuit preferably takes the form of an Exclusive Or gate, and causes the lighting elements to activate only when one of the pressure switches is depressed, such as when the wearer is walking. When both are depressed, such as when the wearer is standing in one place, and when neither is depressed, such as when the shoe has been removed, the Or gate deactivates the lighting elements. A problem with MacMillan is that no lighting element sequencing is provided.

Hwang, et al., U.S. Pat. No. 5,396,720, issued on Mar. 14, 1995, discloses a fixing structure for a lighting circuit 2 stage switch on lighting shoe. Hwang, et al., includes a shoe having a heel with a channel recessed forwardly into the rear of the heel, vertical fixing holes above and below the channel recess and a transparent fixing block having lugs protruding from its upper face corresponding in location to the fixing holes. In the bottom wall of the channel recess is a receiving hollow for receiving a lighting circuit board. The fixing block is insertable into the heel channel recess and thereupon interconnects with the heel by the lugs fitting into the fixing holes. Lighting elements on the circuit board fit into depressions in the lower face of the transparent fixing block, and when lighted through the circuit, transmit light through the fixing block body to radiate from the exposed block side surfaces flush with the channel recess opening. A problem with Hwang, et al., is that lighting is effectively limited to the heel. Another problem is that while the lighting elements are intended to twinkle, no provision is made for noticeable sequential lighting. If the lighting elements within the block did light in sequence, transmission through the refracting fixing block body would tend to obscure it. See also Hwang, et al., U.S. Pat. No. 5,490,338, issued on Feb. 13, 1996 for a fixing structure for a lighting circuit on a lighting shoe.

Evanyk, U.S. Pat. No. 5,033,212, issued on Jul. 23, 1991, teaches a system for increasing the visibility of an object. The example object provided is a shoe having several light emitting diodes embedded into the shoe outer surface, electrical contacts mounted externally on the shoe and coupled to the LED's and to an electrical control circuit detachably coupled to the shoe. The LED's are selectively illuminated by the control circuit, which may be either a semiconductor chip and battery or a portable electrical kit containing a flashing circuit. The semiconductor chip may include a relaxation oscillator for flashing the LED's sequentially. The portable electrical kit may cause every other LED to be lighted where the LED's are mounted with alternatingly polarity by periodically reversing the current through the circuit. A problem with Evanyk is that the various lighting element flashing circuits it proposes are relatively complex and expensive.

Rodgers, U.S. Pat. No. 4,848,009, issued on Jul. 18, 1989, discloses flashing footwear including lighting elements and a battery. The lighting elements are interconnected through a motion responsive switch, and a timer limits the duration of the light for each lighting element activation. The result is a flashing effect as the wearer walks or runs. A problem with Rodgers is that no provision is made for sequential or pattern illumination.

Other references include Lin, U.S. Pat. No. 5,406,724, issued on Apr. 18, 1995, for simplified illuminating means for a safety illuminated shoe; Lin, U.S. Pat. No. 5,357,697, issued on Oct. 25, 1994 for a safety illuminated shoe; Shen-Ko, U.S. Pat. No. 5,371,662, issued on Dec. 6, 1994 for a movement-controlled light emitting device; Altman, et al., U.S. Pat. No. 5,237,760, issued on Aug. 24, 1993 for electrically lighted footwear; Sala, U.S. Pat. No. 3,067,322, issued on Dec. 4, 1962 for a light for foot apparel; Rocco, U.S. Pat. No. 3,070,907, issued on Jan. 1, 1963 for an illuminated dancing shoe; Howard, U.S. Pat. No. 993,251, issued on May 23, 1911 for an illuminating system for theatrical display; Beard, U.S. Pat. No. 4,367,515, issued on Jan. 4, 1983 for a roller skate light attachment; Broach, U.S. Pat. No. 4,463,412, issued on Jul. 31, 1984 for an illuminated shoe skate attachment; Taylor, U.S. Pat. No. 4,748,366, issued on May 31, 1988 for novel uses of piezoelectric materials for creating optical effects; Rondial, U.S. Pat. No. 5,052,131, issued on Oct. 1, 1991 for strapped footwear with decorative lighting; Barrocas, U.S. Pat. No. 5,419,061, issued on May 30, 1995 for a lighted insert for footwear and method; Drago, et al., U.S. Pat. No. 5,461,188, issued on Oct. 24, 1995 for a synthesized music, sound and light system; Silverman, U.S. Pat. No. 5,483,759, issued on Jan. 16, 1996 for footwear or other products; Wu, U.S. Pat. No. 5,303,131, issued on Apr. 12, 1994 for a shoe warning light device; and Rapisarda, et al., U.S. Pat. No. 5,477,435, issued on Dec. 19, 1995 for a module to provide intermittent light with movement.

It is thus an object of the present invention to provide lighted footwear such as a slipper having a lighting assembly including outwardly directed and externally visible lighting elements, means for powering the lighting elements, and means for sequencing the activation of the lighting elements in a repeating cycle.

It is another object of the present invention to provide such footwear having a lighting assembly providing maximized battery life and minimized weight.

It is still another object of the present invention to provide such footwear having a lighting assembly which is compact and easily mounted and concealed within the footwear.

It is finally an object of the present invention to provide such footwear with a lighting assembly which is durable, reliable and inexpensive to manufacture.

SUMMARY OF THE INVENTION

The present invention accomplishes the above-stated objectives, as well as others, as may be determined by a fair reading and interpretation of the entire specification.

A lighted shoe apparatus is provided including a shoe having a shoe body, several outwardly directed and externally visible light emitting elements mounted to the shoe body for lighting in a sequence, an Or gate having Or gate input terminals and an Or gate output terminal, a voltage source connected to the Or gate, a ground wire containing the control switch connected to one of the Or gate input terminals, a clock having a clock input terminal connected to the Or gate output terminal for generating a step output signal when the Or gate output is on and having a clock output terminal, a first counter having a first counter input terminal connected to the clock for translating the step output signal into a counted boolean sequence of numbers and having first counter output terminals, several And gates including a counter controlling And gate, each of the And gates having And gate input terminals and an And gate output terminal, the And gate input terminals being connected in parallel to both of the first counter output terminals, so that each of the And gates receives each counted boolean number, where each of the several light emitting elements is connected to a corresponding one of the And gate output terminals, so that an on signal from each of the And gates causes the corresponding light emitting element to light, and so that an off signal from each And gate causes the corresponding light emitting element to not light, and where the And gates each have a distinctive nipple configuration at the And gate input terminals, so that each And gate generates an on signal to light its corresponding light emitting element selectively for less than all of the boolean numbers generated by the first counter, thereby lighting the light emitting elements in a given the sequence, a second counter having a second counter input terminal and a second counter output terminal, where the counter controlling And gate is connected to the second counter input terminal, a cycle restarting And gate having a cycle restarting And gate input terminal and a cycle restarting And gate output terminal, where the second counter output terminal is connected to the cycle restarting And gate input terminal, and where the several Boolean numbers generated by the second counter cause the cycle restarting And gate to generate an off signal and at least one Boolean number causes the And gate to generate an on signal, where the cycle restarting And gate output terminal is connected to one of the Or gate input terminals, and where an on signal generated by the cycle restarting And gate causes the Or gate to generate an on signal to reactivate the clock, so that the counting and lighting cycle begins again, a control switch for activating and deactivating the logic circuit, and an interconnection conductor electrically joining the Or gate and the control switch to one of the Or gate input terminals.

The light emitting elements preferably each include a light emitting diode. The shoe preferably includes an insole and the control switch is preferably a pressure activated switch mounted in the insole for activation with the applied weight of the shoe wearer onto the insole. The shoe body preferably includes a vamp and the light emitting elements are preferably mounted to the vamp. The shoe is preferably a slipper.

The And gates preferably include a first And gate, a second And gate and a third And gate, the first, second and third And gates each having first and second input terminals, and the nipple configuration preferably includes a nipple at the first And gate first and second input terminals, a nipple at the second And gate first input terminal only, a nipple at the third And gate second input terminal only, and a nipple at neither fourth And gate input terminal.

A lighted shoe apparatus is further provided including a shoe having a shoe body, several externally visible light emitting elements mounted to the shoe body for lighting in a sequence, a logic circuit including an Or gate for supplying logic and power to the logic circuit, a clock for generating an output signal, a counter for converting the clock output signal into a number sequence, several And gates each corresponding and connected to one of the light emitting elements for receiving the number sequence and lighting the corresponding light emitting element selectively for certain numbers in the number sequence, a control switch for activating and deactivating the logic circuit, and an interconnection conductor electrically joining the Or gate and the control switch.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
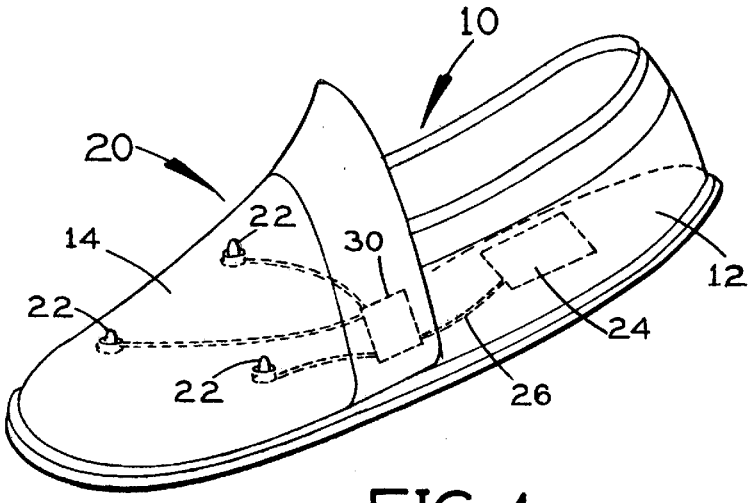
FIG. 1 is a perspective view of the preferred embodiment of the lighted slipper, with the lighting assembly parts inside the slipper shown in broken lines.
Figure 2:
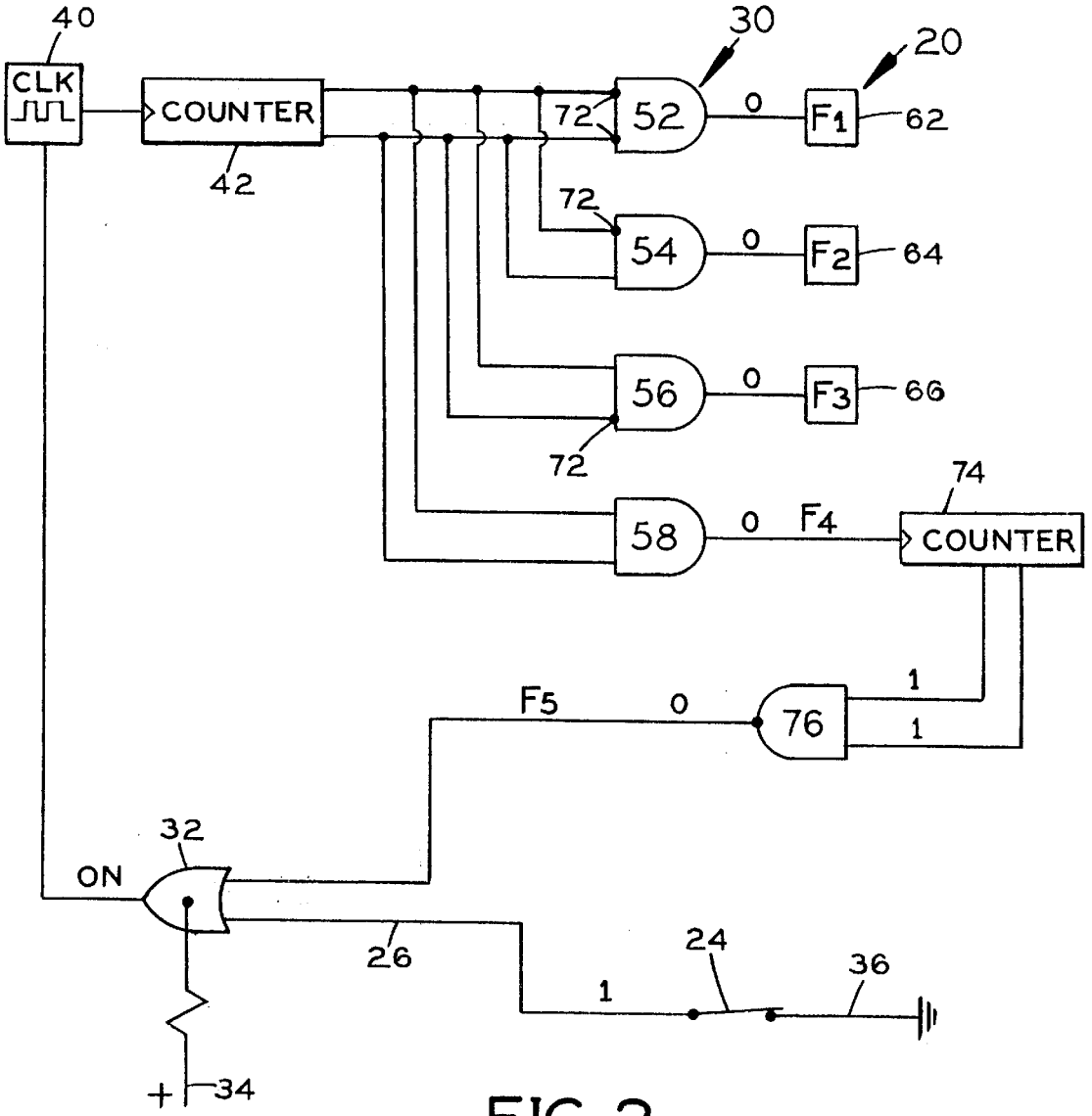
FIG. 2 is a schematic representation of the logic circuit, control switch and light emitting diodes, with off and on signals represented by zeros and ones, respectively. The zeros and ones shown in this FIGURE represent conditions at the instant the control switch is closed.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIGS. 1–9, a lighted slipper 10 is disclosed including a slipper insole 12 and a slipper vamp 14, and containing a lighting assembly 20. Assembly 20 includes an array of outwardly directed light emitting diodes (LED's) 22 mounted to slipper vamp 14 which light in a repeating, flashing sequence when a wearer shifts weight onto the slipper insole 12. See FIG. 1. Assembly 20 further includes a logic circuit 30 including a power source in the form of an Or gate 32; a grounded, pressure-activated control switch 24 hidden underneath slipper insole 12; and interconnection wiring 26 electrically joining the Or gate 32 and the control switch 24.

Or gate 32 makes up the first element of logic circuit 30, and is connected to a voltage source 34. See FIG. 2. A ground wire 36 extends from one terminal of control switch 24, and interconnection wiring 26 connects the other terminal of switch 24 to one Or gate 32 input terminal. The Or gate 32 output terminal is connected to a clock 40 which generates a step output signal when the Or gate 32 output is "on". Clock 40 is in turn connected to a first counter 42 which translates the high end of the step output signal into a counted Boolean number sequence of zero through three. This sequence is generated in the form of zero and one signal combinations delivered through the two first counter 42 output terminals. For example, the count of two is delivered in the form of a "zero" from the first counter 42 first output terminal and a simultaneous "one" from the first counter 42 second output terminal. Both input terminals of each of four And gates, 52, 54, 56 and 58, respectively, are connected in parallel to both first counter 42 output terminals, so that each And gate 52–58 receives each Boolean number generated by first counter 42. Each of the first three And gates 52–56 is connected at its output terminal to one corresponding LED 62–66, respectively. A "one", or "on", signal from an And gate 52–56 causes the corresponding LED to light, while a "zero", or "off", signal from an And gate causes the corresponding LED to not light.

Figures 3, 4:
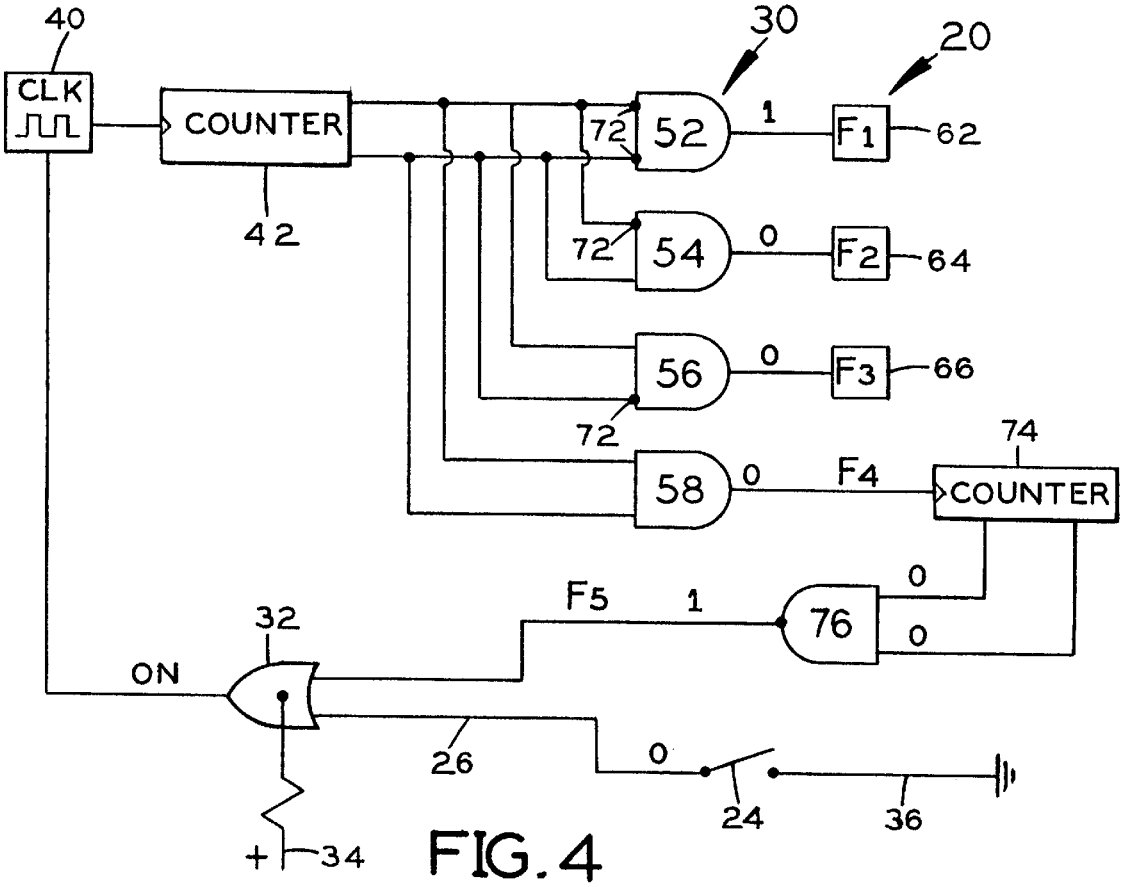
FIG. 3 shows function tables corresponding to elements of the schematic representation of FIG. 2, showing the preferred cycle of zeros and ones generated by each element, progressing through the entire light emitting element lighting sequence.
FIG. 4 is a schematic representation as in FIG. 2, except that the control switch is open and the zeros and ones shown correspond to the first step in the lighting sequence and to the first row of each function table.
Figure 5:
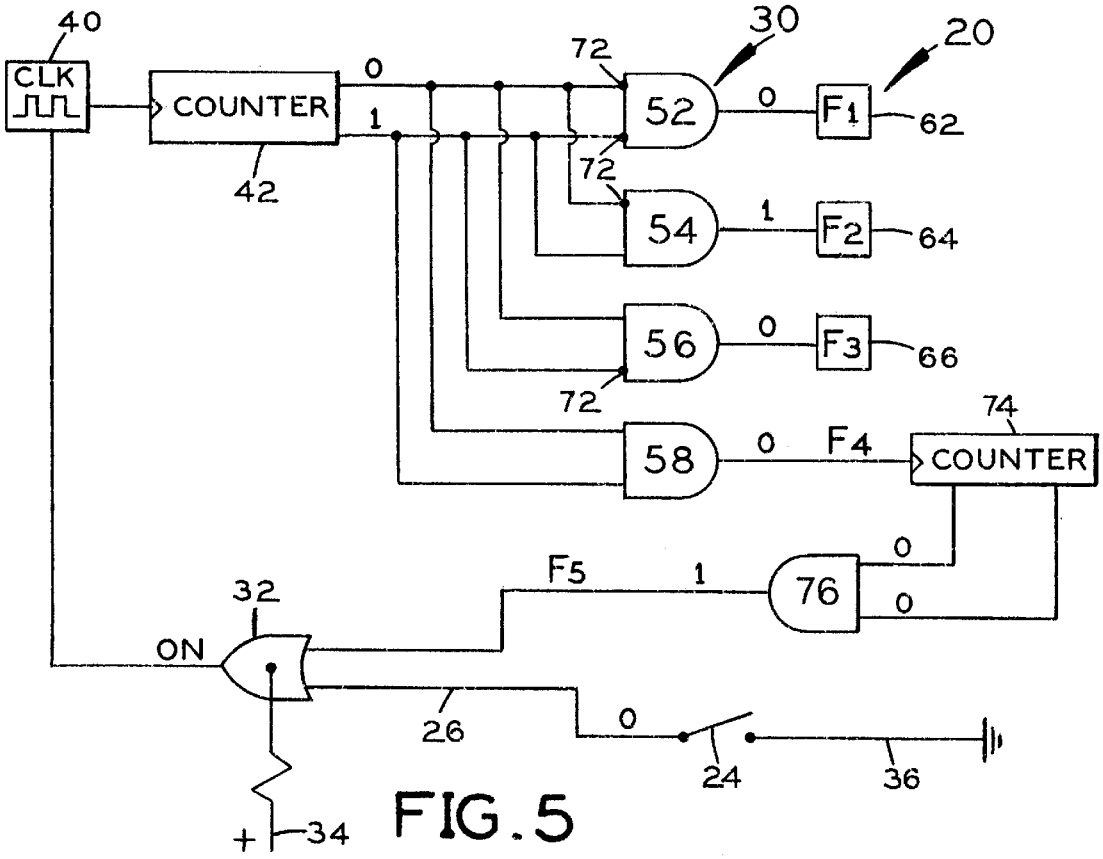
FIG. 5 is a schematic representation as in FIG. 4, except that the zeros and ones shown correspond to the second step in the lighting sequence and to the second row of each function table.
Figure 6:
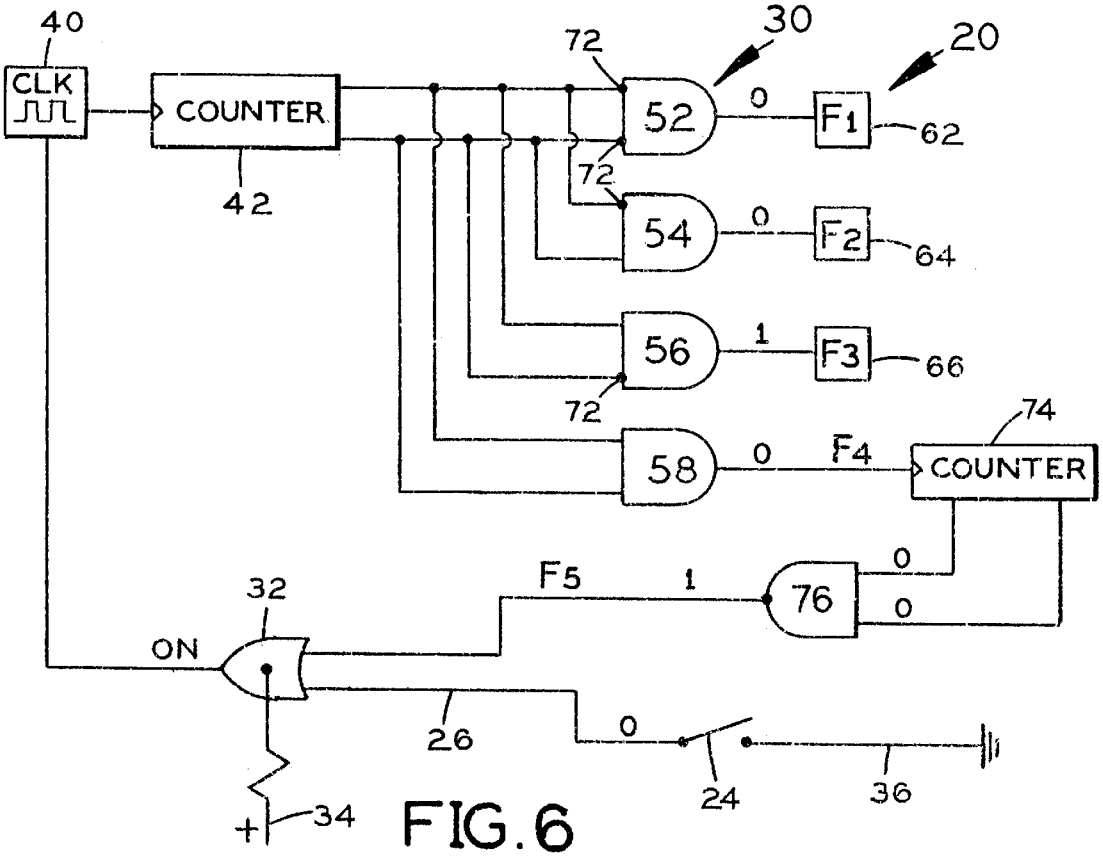
FIG. 6 is a schematic representation as in FIG. 4, except that the zeros and ones shown correspond to the third step in the lighting sequence and to the third row of each function table.

First And gate 52 has a nipple 72 at both input terminals, the second And gate 54 has a nipple 72 at the first input terminal only, the third And gate 56 has a nipple 72 at the second input terminal only, and the fourth And gate 58 has no nipple at either input terminal. As a result of the nipple distribution, each And gate 52–58 generates the "on" signal for a different, single Boolean number combination generated by first counter 42, so that the generation of the sequence of Boolean numbers lights the LED's 62–66 in sequence. FIG. 3 shows function charts indicating the output signals for given input numbers for each And gate. And gates 52–56 are designated by the terms "F1"-"F3", respectively.

Fourth, counter controlling And gate 58 is connected to the input terminal of a second counter 74, and the output terminals of second counter 74 are connected to the input terminals of a fifth, cycle restarting And gate 76. Boolean number combinations of zero through three are generated by second counter 74 and these cause cycle restarting And gate 76 to generate an "off" signal for numbers zero through two and an "on" signal for number three. The cycle restarting And gate 76 output terminal is connected to the second Or gate 32 input terminal, and an "on" signal delivered from cycle restarting And gate 76 causes the Or gate 32 to generate an "on" signal to reactivate the clock 40, so that the cycle begins again. The cycle keeps repeating itself as long as control switch 24 remains open. The cycle stops as soon as the wearer steps off the insole 12 and out of the slipper 10 and control switch 24 is therefore closed, because the switch 24 makes the circuit 30 connection to ground.

Figure 7:
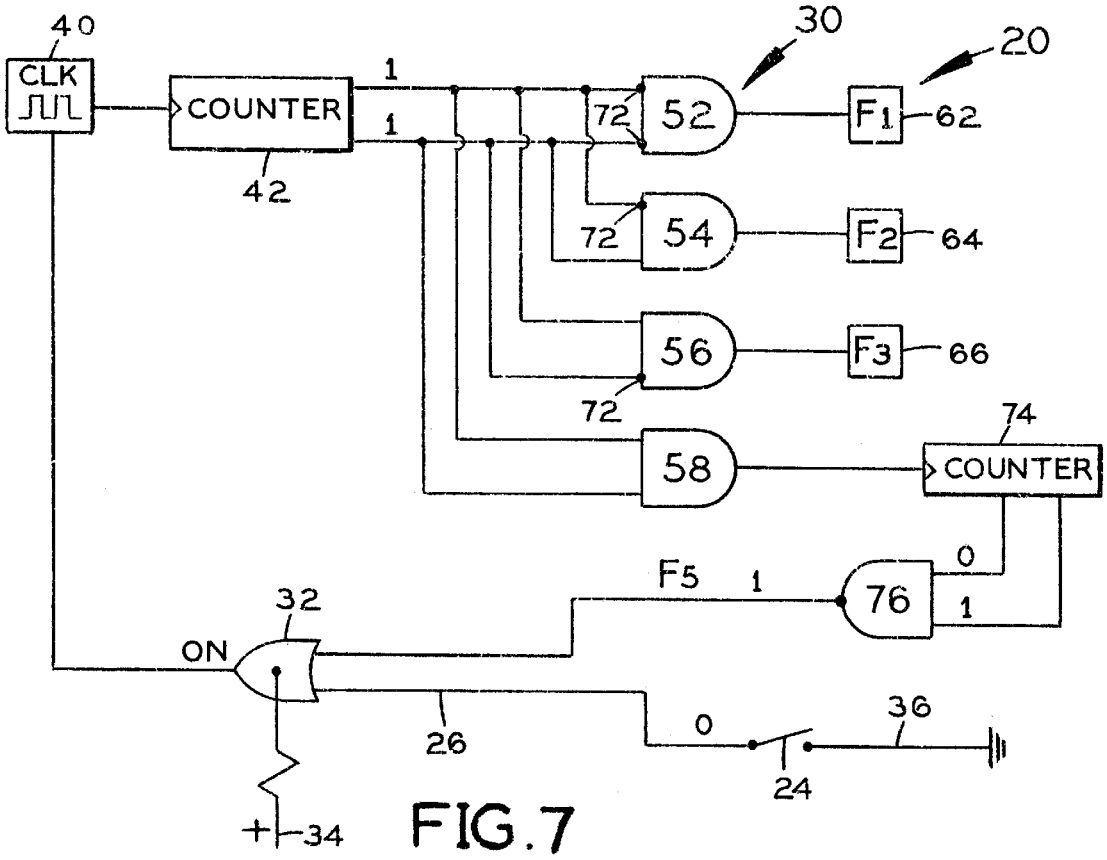
FIG. 7 is a schematic representation as in FIG. 4, except that the zeros and ones shown correspond to the fourth step in the lighting sequence and to the fourth row of each function table.
Figure 8:
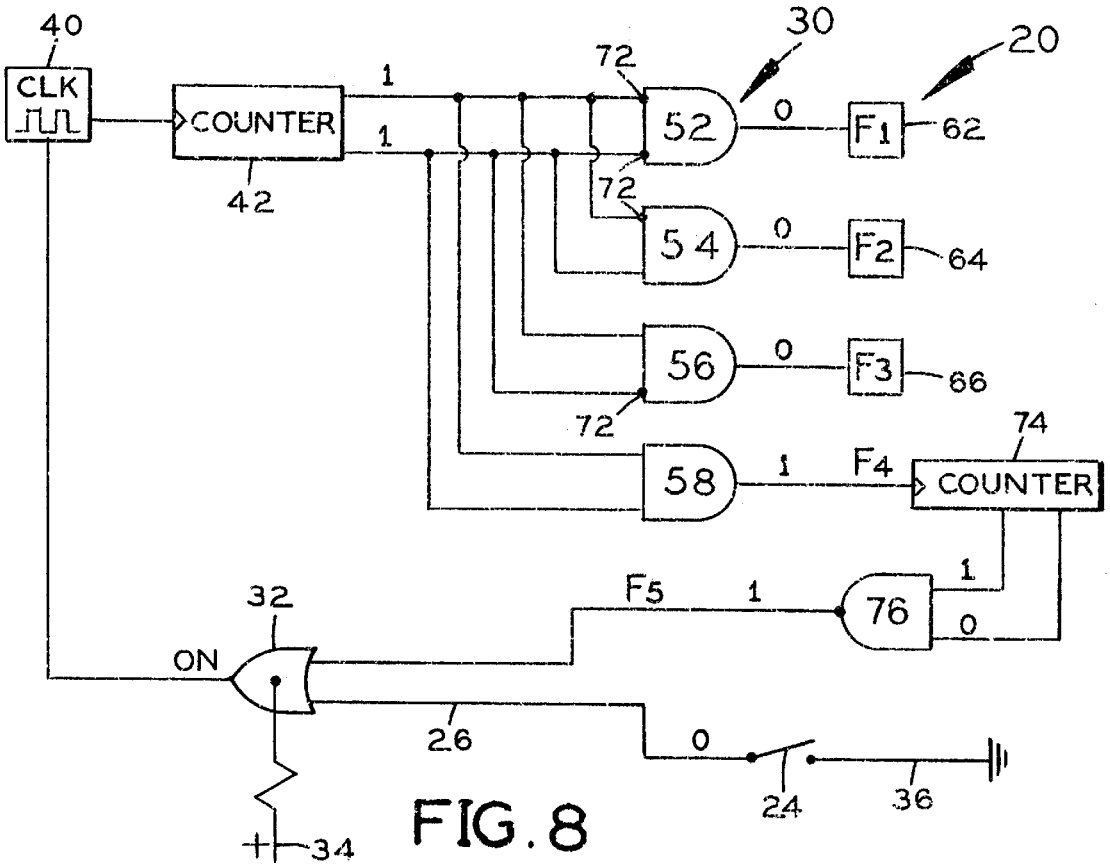
FIG. 8 is a schematic representation as in FIG. 7, except that the zero and one shown generated by the second counter are reversed as a result of the second counter having received a one number signal for the final count in the sequence from the counter controlling And gate, these reversed zero and one signals being passed to the cycle restarting And gate.
Figure 9:
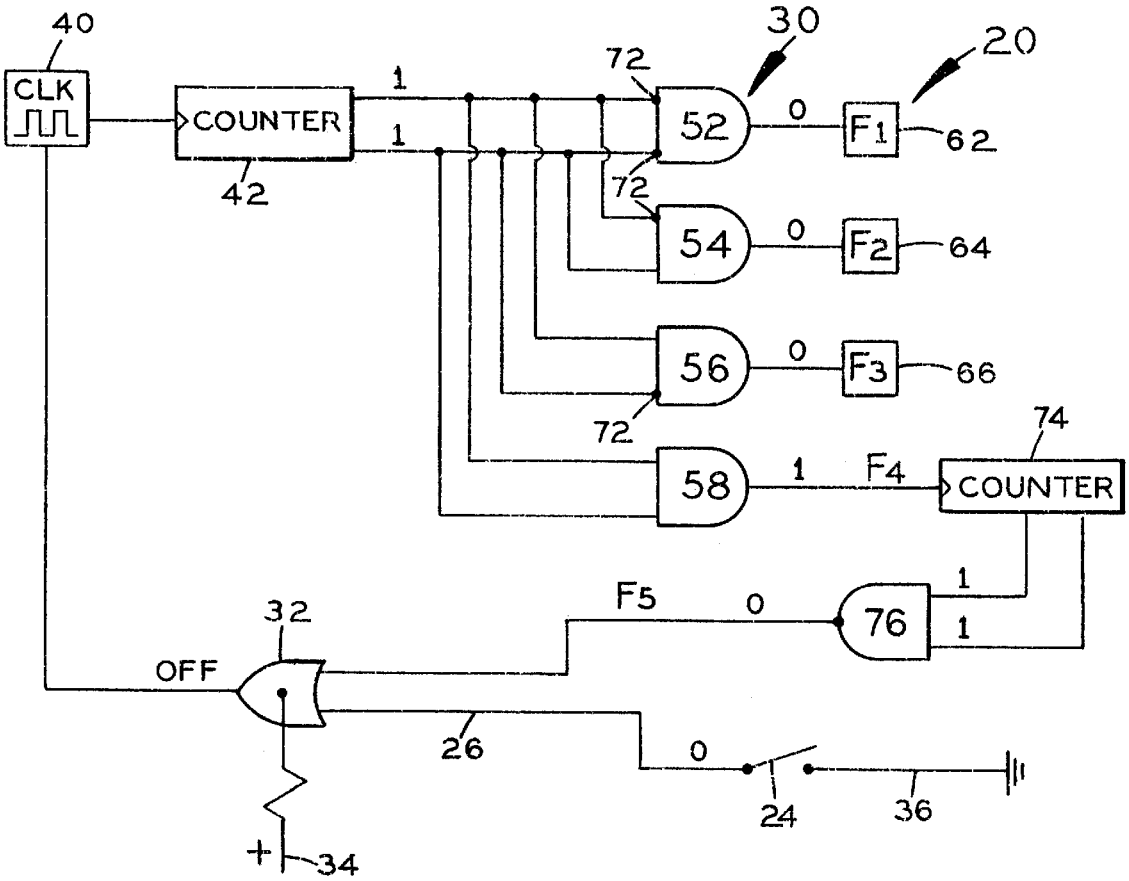
FIG. 9 is a schematic representation as in FIG. 8, except that the cycle restarting And gate is shown passing a zero signal to the Or gate to restart the cycle.

FIGS. 2 and 4–9 show the cycle progression. The three cycle steps immediately following the step shown in FIG. 7 would duplicate the steps shown in FIGS. 4–6. The fourth step following that shown in FIG. 7 is shown in FIG. 8. The three cycle steps immediately following that shown in FIG. 8 would duplicate the steps shown in FIGS. 4–6 once again, and these would be followed by the step shown in FIG. 9. It is emphasized that this illustrated cycle is exemplary only and that other lighting sequences are contemplated.

It is noted that the present invention is not restricted to slippers. Equivalent usage is contemplated in virtually all types of footwear. The LED activation sequence can be in linear or a non-linear lighting order.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A lighted shoe apparatus, comprising:

a shoe having a shoe body, a plurality of outwardly directed and externally visible light emitting elements mounted to said shoe body for lighting in a sequence, an Or gate having Or gate input terminals and an Or gate output terminal, a voltage source connected to said Or gate, a ground wire containing a control switch connected to one said Or gate input terminal, a clock having a clock input terminal connected to said Or gate output terminal for generating a step output signal when said Or gate output is on and having a clock output terminal, a first counter having a first counter input terminal connected to said clock for translating said step output signal into a counted Boolean sequence of numbers and having first counter output terminals, a plurality of And gates, including a counter controlling And gate, each said And gate having And gate input terminals and an And gate output terminal, said And gate input terminals being connected in parallel to both of said first counter output terminals, such that each said And gate receives each counted Boolean number, wherein each of said plurality of light emitting elements is connected to a corresponding one of said And gate output terminals, such that an on signal from each said And gate causes the corresponding said light emitting element to light, and such that an off signal from each And gate causes the corresponding light emitting element to not light, and wherein said And gates each have a distinctive nipple configuration at said And gate input terminals, such that each said And gate generates an on signal to light its corresponding light emitting element selectively for less than all said Boolean numbers generated by said first counter, thereby lighting said light emitting elements in a given said sequence, a second counter having a second counter input terminal and a second counter output terminal, wherein said counter controlling And gate is connected to said second counter input terminal, a cycle restarting And gate having a cycle restarting And gate input terminal and a cycle restarting And gate output terminal, wherein said second counter output terminal is connected to said cycle restarting And gate input terminal, and wherein a plurality of Boolean numbers generated by said second counter cause said cycle restarting And gate to generate an off signal and at least one Boolean number causes said cycle restarting And gate to generate an on signal, wherein said cycle restarting And gate output terminal is connected to one said Or gate input terminal, and wherein an on signal generated by said cycle restarting And gate causes said Or gate to generate an on signal to reactivate said clock, such that the counting and lighting cycle begins again, the control switch for activating and deactivating the logic circuit, and interconnection conductor means electrically joining said Or gate and said control switch to one said Or gate input terminal.

2. An apparatus according to claim 1, wherein said light emitting elements comprise light emitting diodes.

3. An apparatus according to claim 1, wherein said shoe comprises an insole and wherein said control switch is a pressure activated switch mounted in said insole for activation with the applied weight of the shoe wearer onto said insole.

4. An apparatus according to claim 1, wherein said shoe body comprises a vamp and wherein said light emitting elements are mounted to said vamp.

5. An apparatus according to claim 1, wherein said shoe is a slipper.

6. An apparatus according to claim 1, wherein said plurality of And gates comprise a first And gate, a second And gate a third And gate, and a fourth And gate, said first, second and third And gates each having first and second input terminals, and wherein said nipple configuration comprises:

a nipple at the first And gate first and second input terminals, a nipple at the second And gate first input terminal only, a nipple at the third And gate second input terminal only, and a nipple at neither fourth And gate input terminal.

7. A lighted shoe apparatus, comprising:

a shoe having a shoe body, a plurality of outwardly directed and externally visible light emitting elements mounted to said shoe body for lighting in a sequence, an Or gate having Or gate input terminals and an Or gate output terminal, a voltage source connected to said Or gate, a ground wire containing a control switch connected to one said Or gate input terminal, a clock having a clock input terminal connected to said Or gate output terminal for generating a step output signal when said Or gate output is on and having a clock output terminal, a first counter having a first counter input terminal connected to said clock for translating said step output signal into a counted Boolean sequence of numbers and having first counter output terminals, a plurality of And gates, including a counter controlling And gate, each said And gate having And gate input terminals and an And gate output terminal, said And gate input terminals being connected in parallel to both of said first counter output terminals, such that each said And gate receives each counted Boolean number, wherein each of said plurality of light emitting elements is connected to a corresponding one of said And gate output terminals, such that an on signal from each said And gate causes the corresponding said light emitting element to light, and such that an off signal from each And gate causes the corresponding light emitting element to not light, and wherein said And gates each have a distinctive input means configuration at said And gate input terminals, such that each said And gate generates an on signal to light its corresponding light emitting element selectively for less than all said Boolean numbers generated by said first counter, thereby lighting said light emitting elements in a given said sequence, and cycle restarting means.

8. An apparatus according to claim 7, wherein said cycle restarting means comprises:

a second counter having a second counter input terminal and a second counter output terminal, wherein said counter controlling And gate is connected to said second counter input terminal, a cycle restarting And gate having a cycle restarting And gate input terminal and a cycle restarting And gate output terminal, wherein said second counter output terminal is connected to said cycle restarting And gate input terminal, and wherein a plurality of Boolean numbers generated by said second counter cause said cycle restarting And gate to generate an off signal and at least one Boolean number causes said cycle restarting And gate to generate an on signal, wherein said cycle restarting And gate output terminal is connected to one said Or gate input terminal, and wherein an on signal generated by said cycle restarting And gate causes said Or gate to generate an on signal to reactivate said clock, such that the counting and lighting cycle begins again, the control switch for activating and deactivating the logic circuit, and interconnection conductor means electrically joining said Or gate and said control switch to one said Or gate input terminal.

9. A lighted shoe apparatus, comprising:

a shoe having a shoe body, a plurality of outwardly directed and externally visible light emitting elements mounted to said shoe body for lighting in a sequence, an Or gate having Or gate input terminals and an Or gate output terminal, a voltage source connected to said Or gate, a ground wire containing a control switch connected to one said Or gate input terminal, a clock having a clock input terminal connected to said Or gate output terminal for generating a step output signal when said Or gate output is on and having a clock output terminal, a first counter having a first counter input terminal connected to said clock for translating said step output signal into a counted Boolean sequence of numbers and having first counter output terminals, a plurality of And gates, including a counter controlling And gate, each said And gate having And gate input terminals and an And gate output terminal, said And gate input terminals being connected in parallel to both of said first counter output terminals, such that each said And gate receives each counted Boolean number, wherein each of said plurality of light emitting elements is connected to a corresponding one of said And gate output terminals, such that an on signal from each said And gate causes the corresponding said light emitting element to light, and such that an off signal from each And gate causes the corresponding light emitting element to not light, and cycle restarting means.

10. An apparatus according to claim 9, wherein said And gates each have a distinctive nipple configuration at said And gate input terminals, such that each said And gate generates an on signal to light its corresponding light emitting element selectively for less than all said Boolean numbers generated by said first counter, thereby lighting said light emitting elements in a given said sequence.

* * * * *

UNITED STATES PATENT AND TRADEMARK OFFICE

CERTIFICATE OF CORRECTION

PATENT NO. : 5,821,858
APPLICATION NO. : 08/864147
DATED : October 13, 1998
INVENTOR(S) : Stone et al.

It is certified that error appears in the above-identified patent and that said Letters Patent is hereby corrected as shown below:

Title Page, Item (75) Inventor is corrected to read:
-- Allan J. Stone, Weston (FL);
Lin JinXiang, Yuyao (CN); --.

Signed and Sealed this
Fifteenth Day of September, 2015

Michelle K. Lee

Michelle K. Lee
*Director of the United States Patent and Trademark Office*

US005821858C1

(12) REEXAMINATION CERTIFICATE (4795th)

United States Patent

Stone

(10) Number: US 5,821,858 C1

(45) Certificate Issued: Jun. 10, 2003

(54) LIGHTED SLIPPER

(75) Inventor: Allan J. Stone, Weston, FL (US)

(73) Assignee: Cobra International, Inc., Sunrise, FL (US)

Reexamination Request:
No. 90/006,287, May 13, 2002

Reexamination Certificate for:

| | |
|---|---|
| Patent No.: | **5,821,858** |
| Issued: | **Oct. 13, 1998** |
| Appl. No.: | **08/864,147** |
| Filed: | **May 28, 1997** |

(51) Int. Cl.[7] ..... G08B 23/00

(52) U.S. Cl. ..... 340/573.1; 340/691.8; 36/137; 362/103

(56) References Cited

U.S. PATENT DOCUMENTS

| | | | |
|---|---|---|---|
| 4,161,018 A | 7/1979 | Briggs et al. | 362/104 |
| 4,227,251 A | 10/1980 | Kazama et al. | 375/110 |
| 5,381,615 A | 1/1995 | MacMillan | 36/137 |
| 5,903,103 A | 5/1999 | Garner | 315/76 |

*Primary Examiner*—John Tweel

(57) ABSTRACT

A lighted shoe apparatus includes a shoe having a shoe body, several externally visible light emitting elements mounted to the shoe body for lighting in a sequence, a logic circuit including an Or gate for supplying logic and power to the logic circuit, a clock for generating an output signal, a counter for converting the clock output signal into a number sequence, several And gates each corresponding and connected to one of the light emitting elements for receiving the number sequence and lighting the corresponding light emitting element selectively for certain numbers in the number sequence, a control switch for activating and deactivating the logic circuit, and an interconnection conductor electrically joining the Or gate and the control switch. The light emitting elements preferably each include a light emitting diode. The shoe preferably includes an insole and the control switch is preferably a pressure activated switch mounted in the insole for activation with the applied weight of the shoe wearer onto the insole. The shoe body preferably includes a vamp and the light emitting elements are preferably mounted to the vamp. The shoe is preferably a slipper.

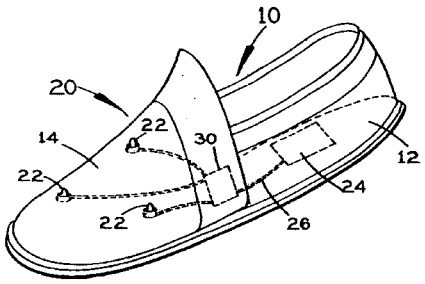

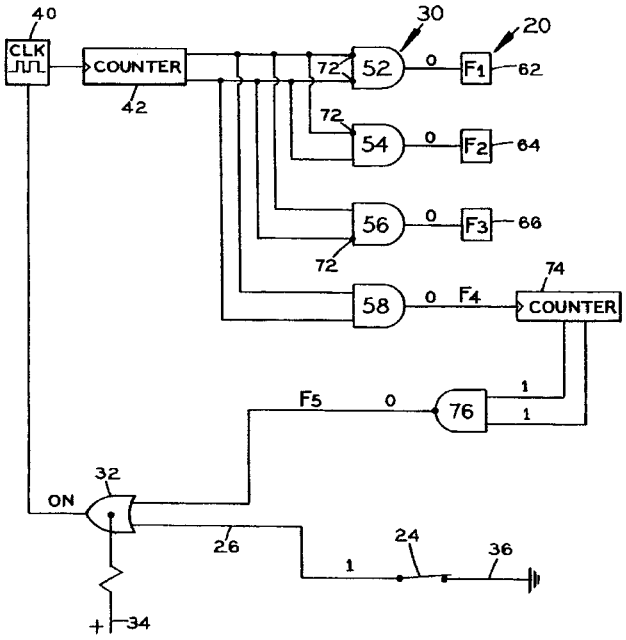

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–10 is confirmed.

* * * * *

US005821858C2

(12) EX PARTE REEXAMINATION CERTIFICATE (7984th)

United States Patent
Stone

(10) Number: US 5,821,858 C2
(45) Certificate Issued: Jan. 11, 2011

(54) LIGHTED SLIPPER

(75) Inventor: Allan J. Stone, Weston, FL (US)

(73) Assignee: Cobra International, In, Sunrise, FL (US)

Reexamination Request:
No. 90/009,161, May 28, 2008

Reexamination Certificate for:

| | |
|---|---|
| Patent No.: | **5,821,858** |
| Issued: | **Oct. 13, 1998** |
| Appl. No.: | **08/864,147** |
| Filed: | **May 28, 1997** |

Reexamination Certificate C1 5,821,858 issued Jun. 10, 2003

(51) Int. Cl.
*G08B 23/00* (2006.01)

(52) U.S. Cl. ..... 340/573.1; 340/691.8; 36/137; 362/103

(58) Field of Classification Search ..... None
See application file for complete search history.

(56) References Cited

U.S. PATENT DOCUMENTS 5,663,614 A 9/1997 Weng et al.
5,680,718 A 10/1997 Ratcliffe et al.
5,812,063 A 9/1998 Weng et al.
5,903,103 A 5/1999 Garner

OTHER PUBLICATIONS

Hayes et al., Student Manual for the Art of Electronics, Cambridge University Press, 1989, p. 298, Figure X13A.7.

*Primary Examiner*—My-Trang Nu Ton

(57) ABSTRACT

A lighted shoe apparatus includes a shoe having a shoe body, several externally visible light emitting elements mounted to the shoe body for lighting in a sequence, a logic circuit including an Or gate for supplying logic and power to the logic circuit, a clock for generating an output signal, a counter for converting the clock output signal into a number sequence, several And gates each corresponding and connected to one of the light emitting elements for receiving the number sequence and lighting the corresponding light emitting element selectively for certain numbers in the number sequence, a control switch for activating and deactivating the logic circuit, and an interconnection conductor electrically joining the Or gate and the control switch. The light emitting elements preferably each include a light emitting diode. The shoe preferably includes an insole and the control switch is preferably a pressure activated switch mounted in the insole for activation with the applied weight of the shoe wearer onto the insole. The shoe body preferably includes a vamp and the light emitting elements are preferably mounted to the vamp. The shoe is preferably a slipper.

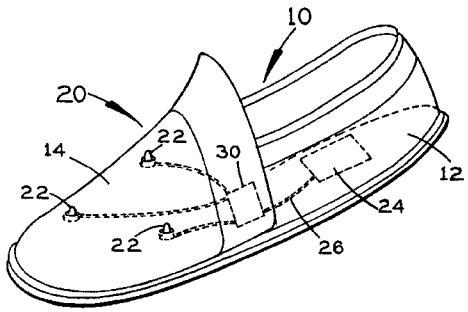

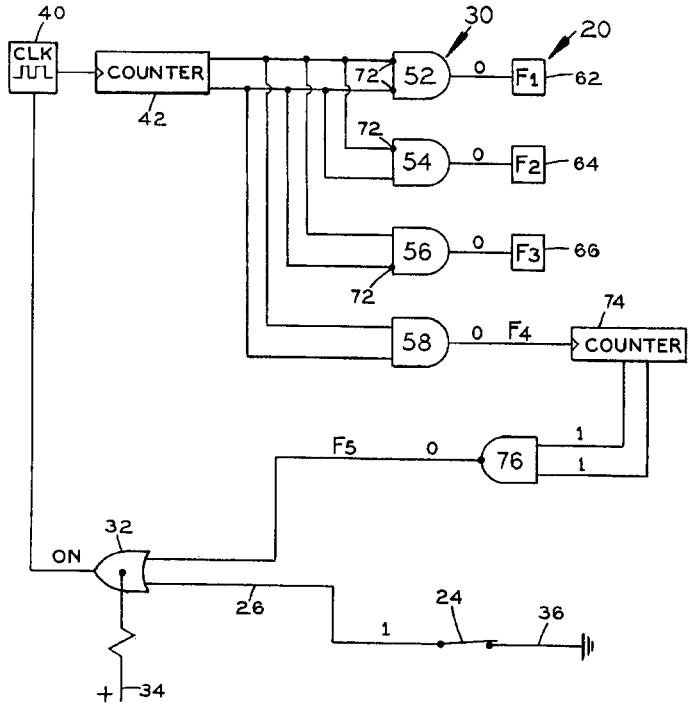

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-6 is confirmed.

Claims 7-9 are determined to be patentable as amended.

Claim 10, dependent on an amended claim, is determined to be patentable.

7. A lighted shoe apparatus, comprising:

a shoe having a shoe body, a plurality of outwardly directed and externally visible light emitting elements mounted to said shoe body for lighting in a sequence, an Or gate having Or gate input terminals and an Or gate output terminal, a voltage source connected to said Or gate, a ground wire containing a control switch connected to one said Or gate input terminal, a clock having a clock input terminal connected to said Or gate output terminal for generating a step output signal when said Or gate output is on and having a clock output terminal, a first counter having a first counter input terminal connected to said clock for translating said step output signal into a counted Boolean sequence of numbers and having first counter output terminals, a plurality of And gates, including a counter controlling And gate, each said And gate having And gate input terminals and an And gate output terminal, said And gate input terminals being connected in parallel to both of said first counter output terminals, such that each said And gate receives each counted Boolean number, wherein each of said plurality of light emitting elements is connected to a corresponding one of said And gate output terminals, such that an on signal from each said And gate causes the corresponding said light emitting element to light, and such that an off signal from each And gate causes the corresponding light emitting element to not light, and wherein said And gates each have a distinctive input means configuration at said And gate input terminals, such that each said And gate generates an on signal to light its corresponding light emitting element selectively for less than all said Boolean numbers generated by said first counter, thereby lighting said light emitting elements in a given said sequence,

*a second counter having a second counter input terminal and a second counter output terminal, wherein said counter controlling And gate is connected to said second counter input terminal,* and cycle restarting means.

8. An apparatus according to claim 7, wherein said cycle restarting means comprises:

[a second counter having a second counter input terminal and a second counter output terminal, wherein said counter controlling And gate is connected to said second counter input terminal,]

a cycle restarting And gate having a cycle restarting And gate input terminal and a cycle restarting And gate output terminal, wherein said second counter output terminal is connected to said cycle restarting And gate input terminal, and wherein a plurality of Boolean numbers generated by said second counter cause said cycle restarting And gate to generate an off signal and at least one Boolean number causes said cycle restarting And gate to generate an on signal, wherein said cycle restarting And gate output terminal is connected to one said Or gate input terminal, and wherein an on signal generated by said cycle restarting And gate causes said Or gate to generate an on signal to reactivate said clock, such that the counting and lighting cycle begins again, the control switch for activating and deactivating the logic circuit, and interconnection conductor means electrically joining said Or gate and said control switch to one said Or gate input terminal.

9. A lighted shoe apparatus, comprising:

a shoe having a shoe body, a plurality of outwardly directed and externally visible light emitting elements mounted to said shoe body for lighting in a sequence, an Or gate having Or gate input terminals and an Or gate output terminal, a voltage source connected to said Or gate, a ground wire containing a control switch connected to one said Or gate input terminal, a clock having a clock input terminal *logically directly* connected to said Or gate output terminal for generating a step output signal when said Or gate output is on and having a clock output terminal, a first counter having a first counter input terminal connected to said clock for translating said step output signal intoa counted Boolean sequence of numbers and having first counter output terminals, a plurality of And gates, including a counter controlling And gate, each said And gate having And gate input terminals and an And gate output terminal, said And gate input terminals being connected in parallel to both of said first counter output terminals, such that each said And gate receives each counted Boolean number, wherein each of said plurality of light emitting elements is connected to a corresponding one of said And gate output terminals, such that an on signal from each said And gate causes the corresponding said light emitting element to light, and such that an off signal from each And gate causes the corresponding light emitting element to not light, and cycle restarting means.

* * * * *